US005994883A

United States Patent [19]

Liu

[11] Patent Number: 5,994,883

[45] Date of Patent: Nov. 30, 1999

[54] ALTERNATING CURRENT POWER CONTROL DEVICE

[76] Inventor: Daniel Liu, 4F, No. 10, Alley 59, Lane 42, Min Chuan Road, Taipei, Taiwan

[21] Appl. No.: 09/209,010

[22] Filed: Dec. 11, 1998

[51] Int. Cl.[6] ..... G05F 1/40

[52] U.S. Cl. ..... 323/237; 323/320

[58] Field of Search ..... 323/235, 237, 323/239, 241, 319, 320, 322, 324, 325

[56] References Cited

U.S. PATENT DOCUMENTS

| | | | |
|---|---|---|---|
| 3,990,000 | 11/1976 | Digneffe | 323/322 |
| 4,009,091 | 2/1977 | Washington et al. | 204/228 |
| 4,740,883 | 4/1988 | McCollum | 364/140.05 |
| 4,800,330 | 1/1989 | Pelonis | 323/243 |
| 4,968,927 | 11/1990 | Pelonis | 323/243 |
| 5,239,252 | 8/1993 | Runggaldier et al. | 318/806 |
| 5,614,811 | 3/1997 | Sagalovich et al. | 323/207 |
| 5,818,707 | 10/1998 | Seong et al. | 363/89 |
| 5,892,391 | 4/1999 | Hughes | 327/438 |

*Primary Examiner*—Adolf Deneke Berhane
*Attorney, Agent, or Firm*—Dougherty & Troxell

[57] ABSTRACT

An alternating current power control device for controlling the amount of power energy supplied to an electric load by controlling the cycle numbers of an alternating current power source in a predetermined cycle period is disclosed. The control device includes a voltage zero-crossing detecting circuit, a current detector, a power adjusting circuit, a control unit, an output driving circuit, and a switching circuit. The switching circuit is connected in series between the alternating current power source and the load. The control unit generates a control signal to control the switching circuit according to a voltage counting pulses generated by the voltage zero-crossing detecting circuit, a current counting pulse generated by the current detector, and a power adjusting signal generated by the power adjusting circuit to determine the cycle numbers of the alternating current power source supplied to the load.

5 Claims, 5 Drawing Sheets

ALTERNATING CURRENT POWER CONTROL DEVICE

BACKGROUND OF THE INVENTION

1. Field of the Invention

The present invention relates to an alternating current power control device, and more especially to an alternating current power control circuit capable of controlling the amount of power energy supplied to an electric load by controlling cycle numbers of an alternating current power source in a predetermined cycle period.

2. Description of the Prior Art

In industrial applications, it is often necessary to control the power energy of an alternating current. For example, in controlling the rotary speed of an alternating current motor, various known approaches may be used to control the electric power energy supplied to the motor by using means, such as an inverter, a TRIAC, a mechanical gear, or by changing the winding turns of the motor.

In case that the rotary speed of the motor is required to be controlled precisely, a known inverter is frequently used in the prior art. However, the control circuit of the inverter commercially available in this art is relatively complex and the cost is very high. Thus, in some applications where precise control is unnecessary, the conventional inverter does not meet the requirements in economic consideration.

For example, in the rotary speed control of a conventional heat radiating fan, it is desired to control the rotary speed of the fan motor according to the temperature of environment so to save more power energy. That is, when the environment temperature is high, the rotary speed of the fan is increased to enhance the heat dissipating capability; while when the environment temperature is low, the rotary speed of the fan may be decreased to save power energy.

In order to control the rotary speed of the fan motor in prior art, a TRIAC is frequently used. Basically, the TRIAC controls the amount of power energy supplied to the load by controlling the phase angle of each cycle of the alternating current power source. However, the control circuit by using TRIAC will generate serious electromagnetic interference during turn on or turn off the current flow.

SUMMARY OF THE INVENTION

Accordingly, the primary object of the present invention is to provide an alternating current power control device capable of controlling the amount of the output power energy supplied to an electric load. The control device controls the output power energy by controlling the cycle numbers of the alternating current power source to the load in a predetermined cycle period, instead of using frequency variation approach as used in the inverter or phase angle control as used in TRIAC control circuit. Another object of the present invention is to provide an alternating current power control circuit without electromagnetic interference. The present invention mainly includes a switching circuit, a voltage zero-crossing detector, a current detector, a power adjusting circuit, and a control unit. The switching circuit is connected between the alternating current power source and the load and it performs turn-on or turn-off operation at a zero-crossing point of the alternating current power source under control of the control unit, so that no electromagnetic interference is occurred during switching. The control circuit of the present invention is suitable to control a resistive load, a inductive load, or a capacitive load.

A further object of the present invention is to provide an alternating current power control device with over current protecting function. The present invention includes a current peak value detector and a RMS current value detector. When a current flow to the load reaches a predetermined current peak value or a current RMS value flow to the load reaches a predetermined current RMS value, an over current signal will be received by the control unit, and then the control unit may turn off the switching circuit, so as to protect the load. In addition, a fuse may be connected in series between the switching circuit and the alternating current power source for further protecting the control circuit and load from over current.

The other object of the present invention is to provide an alternating current power control device with circuit loop fault detecting function. In case that the circuit loop between the alternating current power source and the load is in normal condition, an alarm will not be actuated. In case that the circuit is in abnormal condition, the alarm will be actuated.

To further understand the present invention, reference is made to the following detailed description of a preferred embodiment of the present invention, as well as the attached drawings, wherein:

DETAILED DESCRIPTION OF THE PREFERRED EMBODIMENT

Figure 1:
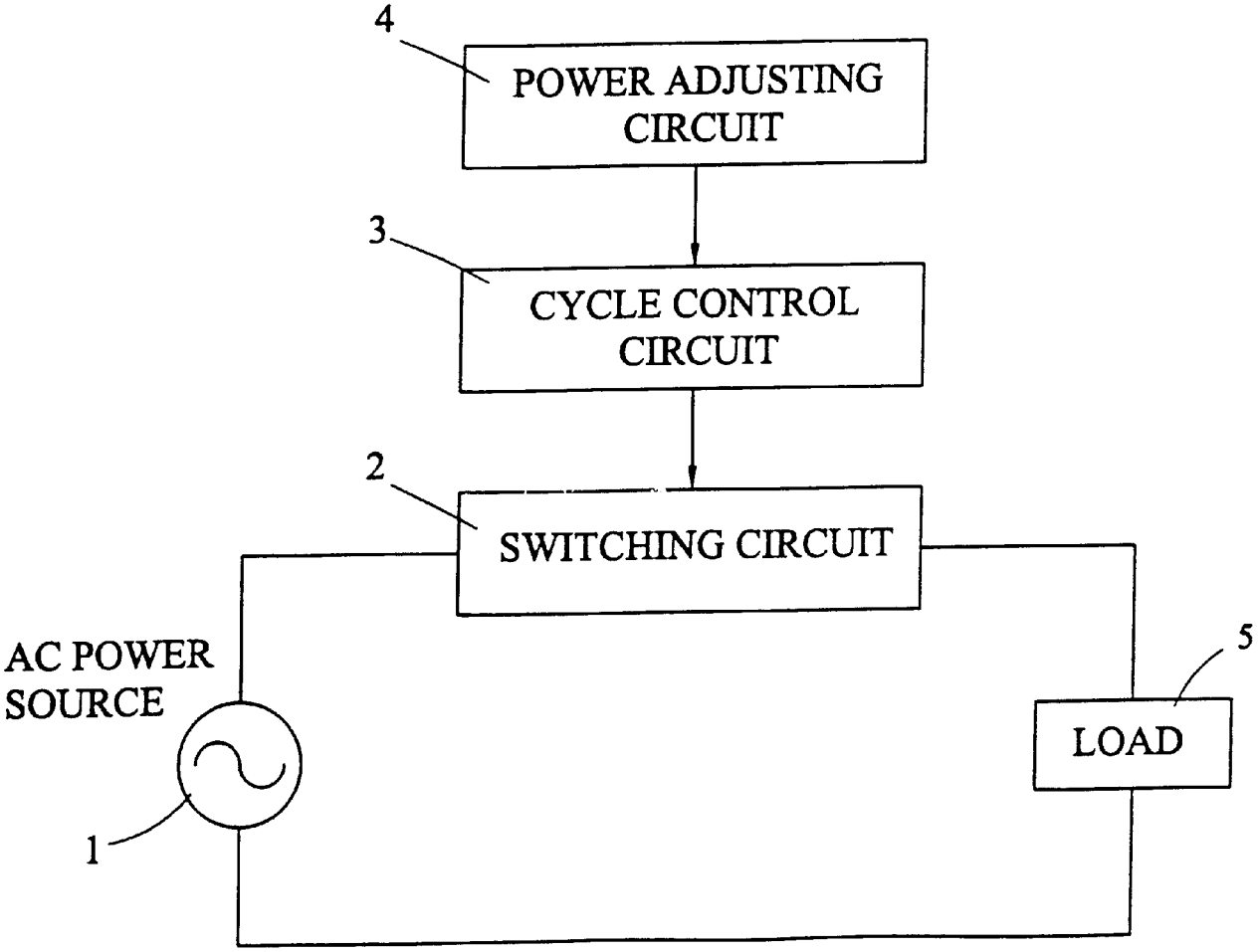
FIG. 1 is a functional circuit block diagram of the present invention.

As shown in FIG. 1, a functional circuit block diagram of the present invention is shown. The alternating current power control device of the present invention is mainly composed of a switching circuit 2, a cycle control circuit 3, and a power adjusting circuit 4. The switching circuit 2 is connected in series between an alternating current power source 1 and an electric load 5 to be controlled. The cycle control circuit 3 may control the amount of the output electric power energy supplied to the load 5 via the switching circuit 2 by controlling the output cycle numbers supplied to the load 5 from the alternating current power source 1.

The cycle control circuit 3 may receive a power adjusting signal sent from the power adjusting circuit 4 for manually or automatically changing the amount of electric power energy to the load 5.

Therefore, for example, in case that the load is a resistive load, such as a heater, the temperature of the heater may be easily controlled by the control device of the present invention. In case that the load is an alternating current motor, the rotary speed of the motor may be controlled by the control device of the present invention.

Figure 2:
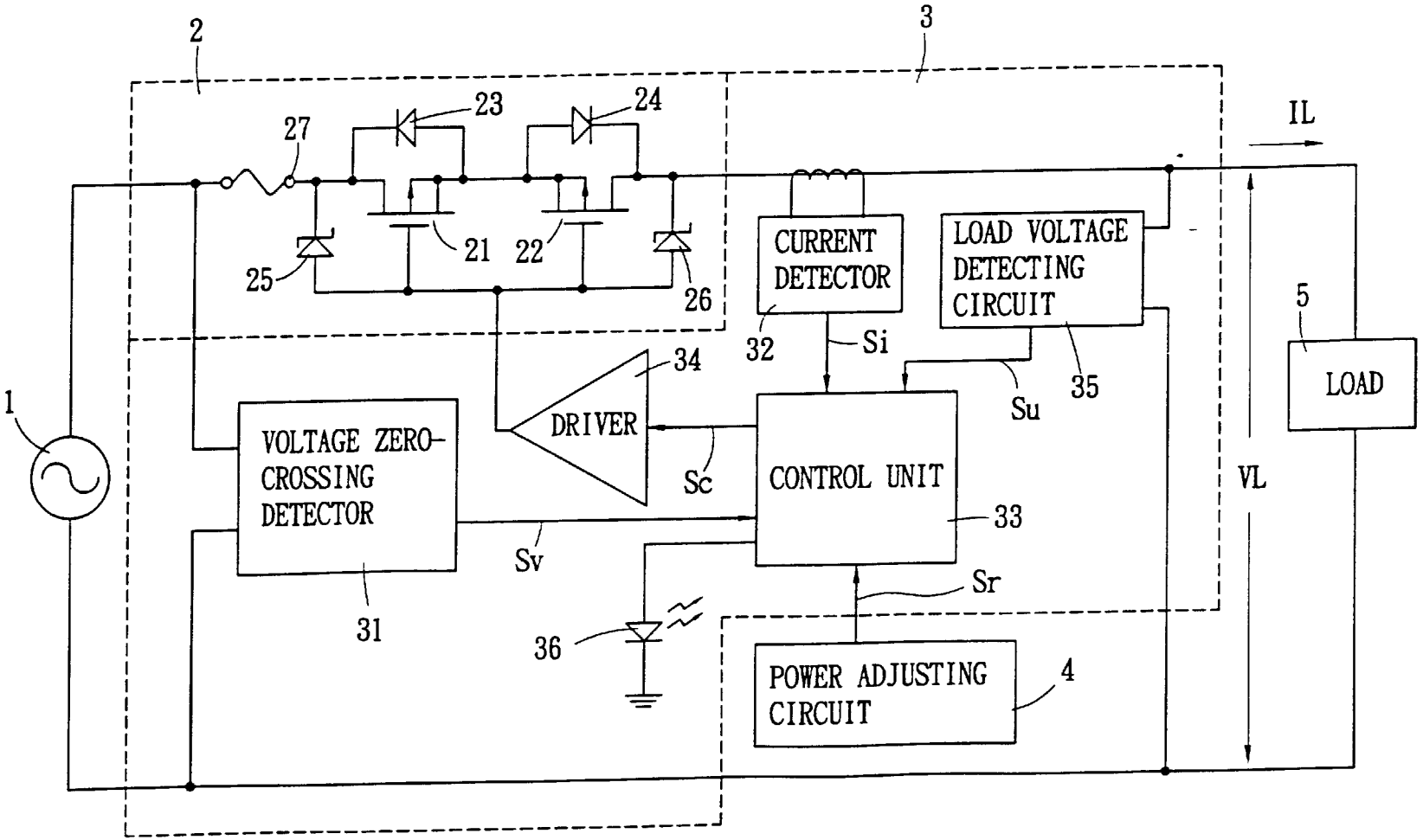
FIG. 2 is a circuit diagram of a preferred embodiment in accordance with the present invention.

FIG. 2 shows a circuit diagram of a preferred embodiment of the present invention. As shown in the figure, the switching circuit 2 includes a first switching element 21 and a second switching element 22 with their drains and sources connected in series. The switching elements may be such as MOSFETs, IGBTs, or other power control elements with similar function. The gates of the two switching elements are connected with each other.

A diode 23 is connected in parallel between the source and drain of the first switching element 21, and a Zener diode 25 is connected in parallel between the drain and the gate of the first switching element 21. Similarly, a diode 24 is connected in parallel between the source and drain of the second switching element 22, and a Zener diode 26 is connected in parallel between the drain and the gate of the second switching element 21.

The cycle control circuit 3 mainly contains a voltage zero-crossing detecting circuit 31, a current detector 32, a control unit 33, and a driving circuit 34.

Figure 3:
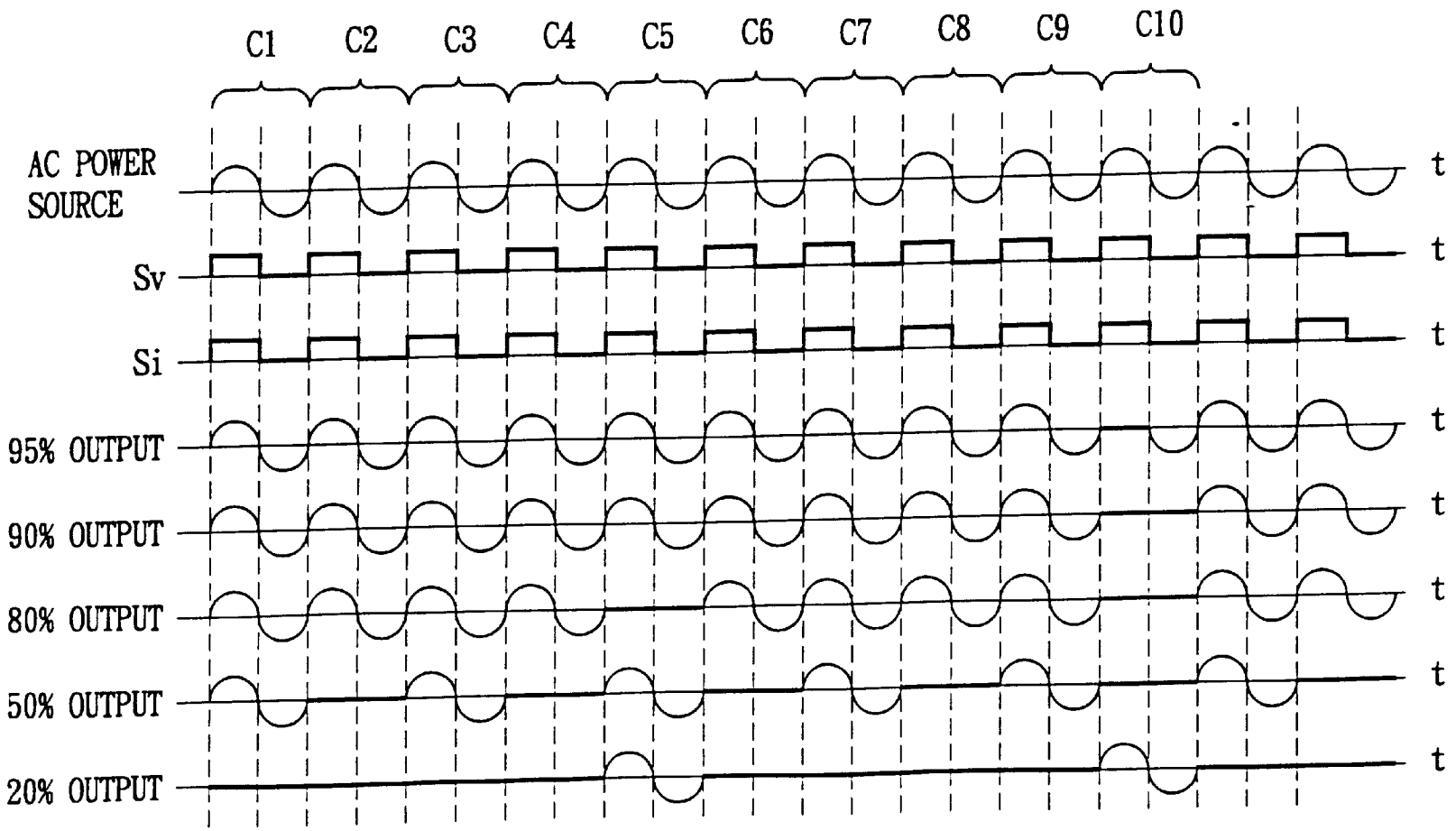
FIG. 3 is a waveform diagram showing related signals of the present invention.

Two input ends of the voltage zero-crossing detecting circuit 31 are connected across the alternating current power source 1 for detecting the zero-crossing point of each cycle of the alternating current power source 1. Each time the alternating current power source sends out a full cycle of a sine wave, the voltage zero-crossing detecting circuit 31 generates a voltage counting pulse Sv at its output end to the control unit 33. The timing between the voltage counting pulse Sv and the alternating current power source AC is shown in FIG. 3.

The current detector 32 serves to detect the current flow IL from the alternating current power source 1 to the load 5. When the current detector 32 detects a zero point of the electric current flowing to the load 5, a current counting pulse Si is outputted from the output end thereof to the control unit 33. The timing of the current counting pulse Si and the alternating current power source AC is also shown in FIG. 3.

In case that the load 5 is a resistive load, the voltage counting pulse Sv and the current counting pulse Si are in phase. In case that the load is a reactive or a capacitive load, a phase angle difference exists between the voltage counting pulse Sv and the current counting pulse Si.

The control unit 33 is employed to receive the voltage counting pulse Sv sent from the voltage zero-crossing detecting circuit 31 and the current counting pulse Si sent from the current detector 32. In addition, the control unit 33 is also capable of receiving a power adjusting signal Sr from the power adjusting circuit 4.

The control unit 33 sends an output control signal Sc at its output end according to the power adjusting signal Sr, the voltage counting pulse Sv, and the current counting pulse Si. The control unit 33 may be formed by a known logic circuit or a microprocessor.

The input end of the driving circuit 34 receives the output control signal Sc sent from the control unit 33. The output end of the driving circuit 34 is connected with the gates of the two switching elements 21 and 22. Therefore, the output control signal Sc generated by the control unit 33 is capable of controlling the ON/OFF states of the switching elements 21 and 22 through the driving circuit 34.

The power adjusting circuit 4 is capable of generating a power adjusting signal Sr to manually or automatically adjust the amount of the output power supplied to the load 5. For example, in application of controlling a fan for dissipating heat, the power adjusting circuit 4 may include a thermal sensitive resistor. The cycle control circuit 3 may control the switching circuit 2 to supply more power energy from the power source to the fan when the temperature of the environment reaches a preset temperature level, so as to increasing the heat dissipating efficiency. In contrast, when the temperature of the environment is decreased to a present lower temperature level, the cycle control circuit 3 may control the switching circuit 2 to supply less power energy to the fan, so as to save unnecessary power consumption.

The power adjusting circuit 4 may be a known manual adjusting circuit for manually adjusting the power energy to the load. For example, the power adjusting circuit 4 may include a variable resistor which can be manually controlled by user. The power adjusting signal generated from the power adjusting circuit 4 may be a remote control signal, a delay control signal, or a series of sequential control signals.

A fuse 27 may be connected in series between the switching circuit 2 and the alternating current power source 1 for protecting the control circuit and load from over current.

In a preferred embodiment of the present invention, a load voltage detector 35 is employed to detect the voltage across the load, serving as a circuit loop fault detecting circuit. The load voltage detector 35 is capable of generating a load voltage signal Su to the control unit 33. When the current power source 1 is supplying normally, while the circuit loop is in fault condition, for example that the fuse 27 is burnt out or one of the switching elements 21 and 22 is burnt, a load voltage signal Su is sent to the control unit 33.

Therefore, the control unit 33 may determine whether a fault condition is exhibited by checking the voltage counting pulse Sv sent from the voltage zero-crossing detecting circuit 31 and the load voltage signal Su sent from the load voltage detecting circuit 35. Preferably, the control unit 33 may include an alarm device, such as an alarm lamp or a speaker, for noticing the fault condition.

FIG. 3 is a timing diagram showing the waveforms of the present invention. A basic control period covering ten cycles C1 to C10 therein is illustrated as an example for explanation. In case a 95% output power energy of the alternating current power source is desired to supply to the load, the control circuit of the present invention will cut off the positive half cycle of the tenth cycle C10 in the basic control period and each following basic control periods. So, the output energy supplied to the load will be 95% to the alternating current source. In case a 90% output power energy of the alternating current power source is desired to supply to the load, the full cycle of the tenth cycle C10 in each basic control period is cut off. In case a 80% output power energy of the alternating current power source is desired to supply to the load, the fifth cycle C5 and the tenth cycle C10 in each basic control period are cut off. In case a 50% output power energy of the alternating current power source is desired to supply to the load, one full cycle of every two cycles is cut off. In case a 20% output power energy of the alternating current power source is desired to supply to the load, only the fifth cycle C5 and the tenth cycle C10 are permitted to supply to the load. By the aforementioned way, the output energy to the load may be easily controlled as desired.

Figure 4A:
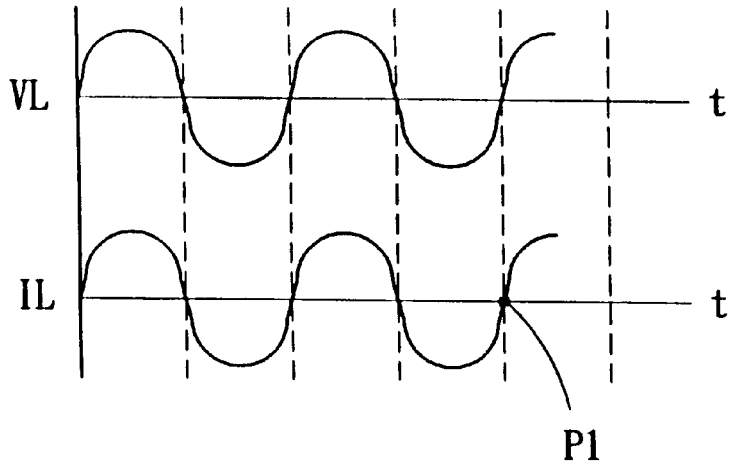
FIG. 4A is a waveform diagram showing a phase angle relation of a load voltage VL and a load current IL of a resistive load in accordance with the present invention.

In application, if the load is a resistive load, the load voltage VL and the load current IL are in phase, as shown in FIG. 4A. Since a voltage zero-crossing detecting circuit 31 is included in the present invention, the control unit 33 may easily control that the turn off circuit switches exactly at current zero-crossing point P1 according to the voltage counting pulse Sv sent from the voltage zero-crossing detecting circuit 31.

Figure 4B:
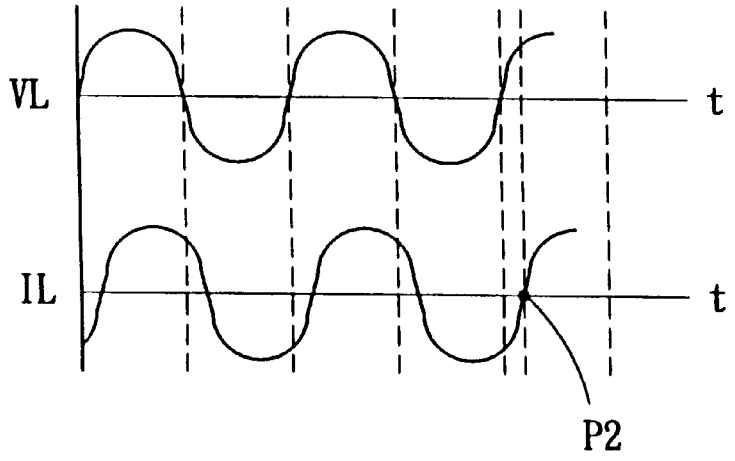
FIG. 4B is a waveform diagram showing a phase angle relation of a load voltage VL and a load current IL of an inductive load in accordance with the present invention.

In case that the load is an inductive load, the load current IL lags to the load voltage VL with a certain phase angle, as shown in FIG. 4B. It is preferable that the turn off time of the switching circuit 2 is performed at a current zero point P2 to avoid electromagnetic interference during switching. In the present invention, since a voltage zero-crossing detecting circuit 31 and a current detector 32 are included in the control circuit, the control unit 33 may easily control that the switching circuit switches at a zero-crossing point P2 where the load current IL is zero, according to the voltage counting pulse Sv sent from the voltage zero-crossing detecting circuit 31 and the current counting pulse Si sent from the current detector 32.

Figure 4C:
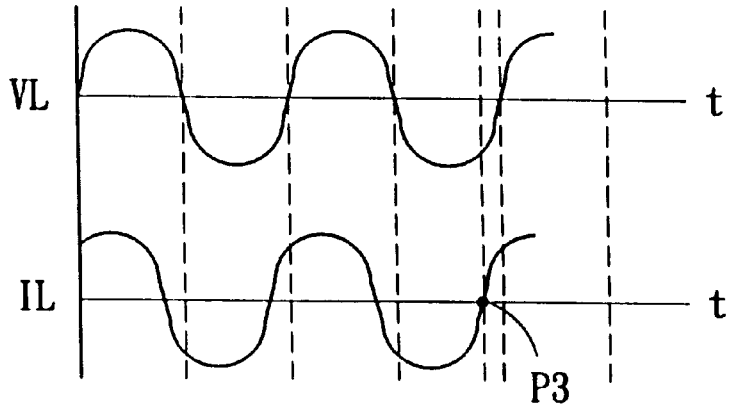
FIG. 4C is a waveform diagram showing a phase angle relation of a load voltage VL and a load current IL of a capacitive load in accordance with the present invention.

In case that the load is a capacitive load, the load current IL leads to the load voltage VL with a certain phase angle, as shown in FIG. 4C. It is preferable that the turn off time of the switching circuit 2 is performed at a current zero point P3 to avoid electromagnetic interference during switching. In the present invention, since a voltage zero-crossing detecting circuit 31 and a current detector 32 are included in the control circuit, the control unit 33 may easily control that the switching circuit switches at a zero-crossing point P3 where the load voltage VL is zero, according to the voltage counting pulse Sv sent from the voltage zero-crossing detecting circuit 31 and the current counting pulse Si sent from the current detector 32.

By means of the aforementioned control manner, the output power energy may be determined as desired by controlling the output cycle numbers to the load. Further, because the cycle control circuit 3 of the present invention controls the switching circuit 2 switching at a zero point where either load voltage is zero or load current is zero, there will be no Electromagnetic Interference occurred during switching.

Figure 5:
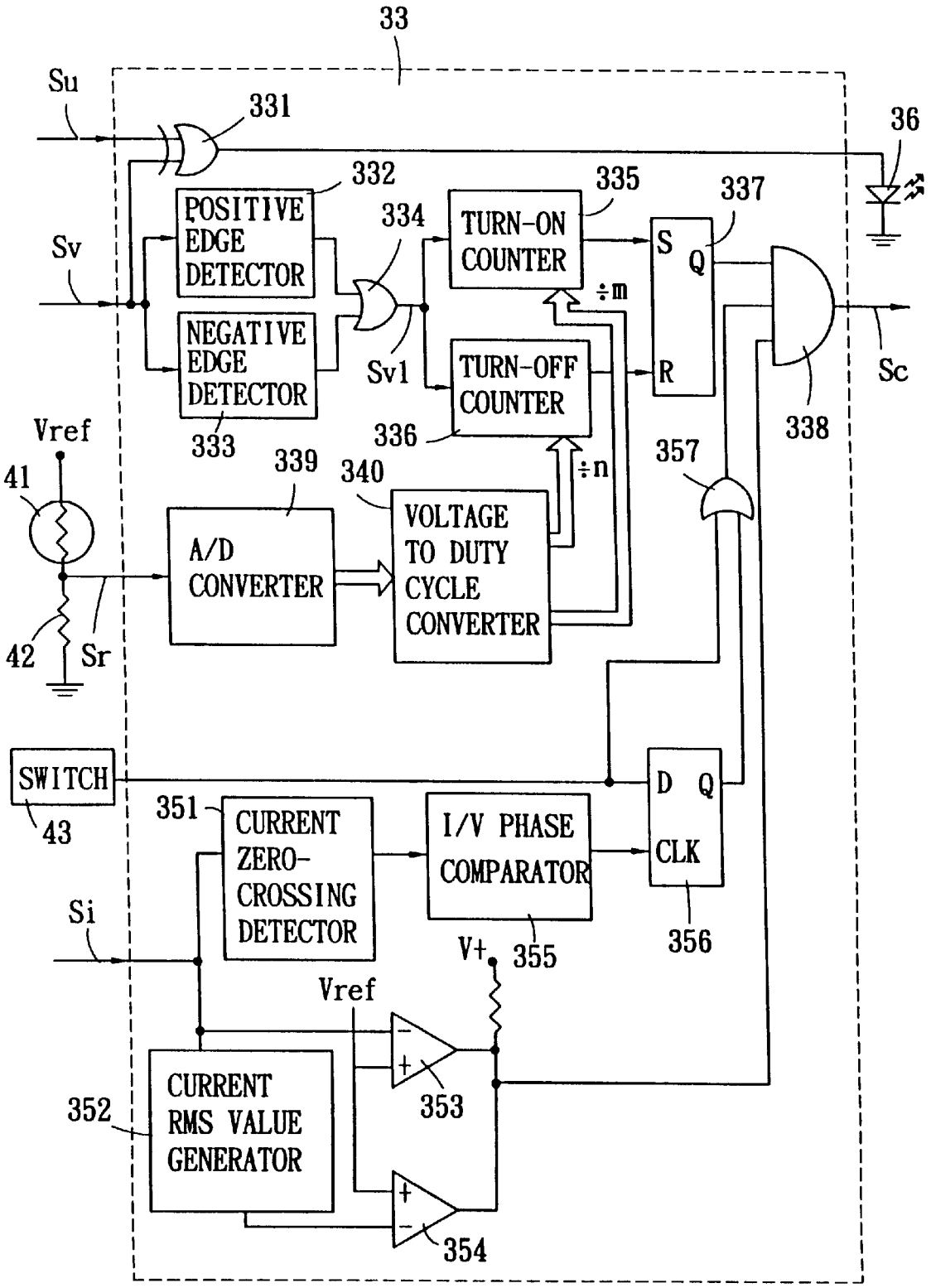
FIG. 5 is a logic circuit diagram of the control unit shown in FIG. 2.

FIG. 5 is a more detailed circuit diagram of the control unit 33 of FIG. 2. As shown in the figure, the voltage counting pulse Sv sent from the voltage zero-crossing detecting circuit 31 and the load voltage signal Su sent from the load voltage detecting circuit 35 are supplied to the input ends of an exclusive OR gate 331 respectively. The output end of the exclusive OR gate is connected to an alarm lamp 36. When the alternating current power source and the load voltage are in phase, the alarm lamp 36 will not light up, representing that the circuit loop is operated normally. In contrast, in case the alternating current power source is supplied normally, but no load voltage is detected by the load voltage detecting circuit, it represents that the circuit loop is in an abnormal condition. At this time, the alarm lamp 36 is lighted to indicate the fault condition.

The voltage counting pulse Sv is further processed to generate a series of counting pulse signal Sv1 via a positive edge detector 332, a negative edge detector 333, and a OR gate 334. A turn-on counter 335 and a turn-off counter 336 are arranged to receive the counting pulse signal Sv1. The turn-on counter 335 and the turn-off counter 336 are employed to determine the ON/OFF time, namely the ON/OFF ratio, of the output power energy.

The ON/Off time of the turn-on counter 335 and the turn-off counter 336 is determined by the signal level of the power adjusting signal Sr sent from the power adjusting circuit 4. In this embodiment, for example, the power adjusting circuit 4 is composed of a thermal-sensitive resistive 41 and a voltage dividing resistor 42 connected in series. The power adjusting signal Sr is supplied to a voltage to duty cycle converter 340 via an analog to digital converter 339. The voltage to duty cycle converter 340 is capable of generating a divided-by-m signal to the turn-on counter 335 and a divided-by-n signal to the turn-off counter 335 respectively, so as to determine the ON/OFF time of the turn-on counter 335 and the turn-off counter 336.

Thereafter, the outputs of the turn-on counter 335 and the turn-off counter 336 are sent to the input ends S and R of a flip flop 337 respectively. The output of the flip flop 337 is supplied to an input terminal of an AND gate 338, and then an output control signal Sc is obtained at the output of the AND gate 338.

The current counting pulse Si sent from the current detector 32 is sent to a current/voltage phase comparator 355 via a current zero-crossing detecting circuit 351, and then the output signal of the current/voltage phase comparator 355 is supplied to a clock pulse input terminal of a D-type flip flop 356. The output terminal Q of the D-type flip flop 356 and the input terminal D are connected to an input of an OR gate 357. Finally, the output end of the OR gate 357 is connected with one of the inputs of the AND gate 338.

The power adjusting circuit of the present invention may include a manually controllable switch 43 for generating a manual power adjusting signal to the control unit 33. The manual power adjusting signal is sent to a data input terminal D of a D-type flip flop 356 and an input terminal of the OR gate 357. In this manner, the amount of the power energy supplied to the load may be adjusted according to the manual power adjusting signal of the switch 43.

A first comparator 353 serving as a current peak value detector is capable of generating a current peak value signal at its output end by receiving the current counting pulse Si generated by the current detector 32 shown in FIG. 2,. In addition, a current RMS (Root Mean Square) value generator 352 and a second comparator 354 serving as a RMS current value detector are capable of generating a current RMS value signal at the output end of the comparator 354 by receiving the current counting pulse Si.

The output signals sent from the comparators 353 and 354 are sent to one input end of the AND gate 338. In such an arrangement, when a current flow to the load reaches a predetermined current peak value or a current RMS value flow to the load reaches a predetermined current RMS value, an over current signal will be presented at the output end of the AND gate 338. The control unit 33 is capable of receiving the over current signal and then turning off the switching circuit, so as to protect the load.

In practice, the control unit 33 may be a logic circuit formed by logic elements as shown in FIG. 5, or may be a micro-process based circuit formed by a micro-process.

Although the preferred embodiments of the present invention have been described to illustrate the present invention, it is apparent that changes and modifications in the specifically described embodiments can be carried out without departing from the scope of the invention which is intended to be limited only by the appended claims.

What is claimed is:

1. An alternating current power control device for controlling an amount of an output power energy to an electric load by controlling cycles numbers of an alternating current power source supplied to the load in a predetermined cycle period, comprising:

a voltage zero-crossing detecting circuit for detecting a zero-crossing point of the alternating current power source and then supplying a series of voltage counting pulses;

a power adjusting circuit for generating a power adjusting signal;

a control unit for receiving the voltage counting pulses generated by the voltage zero-crossing detecting circuit and the power adjusting signal generated by the power adjusting circuit, and thereby generating an output control signal;

an output driving circuit for receiving the output control signal of the control unit and then generating a driving signal; and a switching circuit connected in series between the alternating current power source and the load, controlled by the driving signal of the output driving circuit;

wherein the control unit controls the switching circuit according to the voltage counting pulses of the voltage zero-crossing detecting circuit and the power adjusting signal of the power adjusting circuit to determine the cycle numbers of the alternating current power source to the load so as to control the amount of the output power energy supplied to the load.

2. The alternating current power control device as claimed in claim 1, further comprising a current detector for detecting a current flow from the alternating current power source to the load, and thereby generating a series of current counting pulses to the control unit.

3. The alternating current power control device as claimed in claim 1, further comprising a load voltage detector for detecting the voltage across the load.

4. The alternating current power control device as claimed in claim 1, wherein the power adjusting circuit comprises a thermal-sensitive resistor.

5. The alternating current power control device as claimed in claim 1, further comprising a fuse serially connected between the alternating current power source and the switching circuit.

* * * * *